US012152475B2

(12) United States Patent
El-Mahbes et al.

(10) Patent No.: US 12,152,475 B2
(45) Date of Patent: Nov. 26, 2024

(54) INTAKE FLUID DENSITY CONTROL SYSTEM

(71) Applicant: Baker Hughes Oilfield Operations LLC, Houston, TX (US)

(72) Inventors: Reda El-Mahbes, Houston, TX (US); Leslie Reid, Coweta, OK (US); Maximiliano Gonzalez, Houston, TX (US); Mohammad Masadeh, Midland, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 95 days.

(21) Appl. No.: 17/968,685

(22) Filed: Oct. 18, 2022

(65) Prior Publication Data

US 2024/0125216 A1 Apr. 18, 2024

(51) Int. Cl.
*E21B 43/12* (2006.01)
*E21B 43/38* (2006.01)

(52) U.S. Cl.
CPC ..... *E21B 43/128* (2013.01); *E21B 43/38* (2013.01)

(58) Field of Classification Search
CPC ..... E21B 43/12; E21B 43/121; E21B 43/128; E21B 43/129; E21B 43/13; E21B 43/38
See application file for complete search history.

(56) References Cited

U.S. PATENT DOCUMENTS

| | | | |
|---|---|---|---|
| 2,355,259 | A | 8/1944 | Cotesworth et al. |
| 2,929,501 | A | 3/1960 | Fenske et al. |
| 3,291,057 | A | 12/1966 | Carle |
| 3,986,552 | A | 10/1976 | Scott |
| 4,253,481 | A | 3/1981 | Sarlls |
| 5,207,810 | A | 5/1993 | Sheth |
| 5,271,725 | A | 12/1993 | Freet et al. |
| 5,344,269 | A | 9/1994 | Banks |
| 5,433,269 | A | 7/1995 | Hendrickson |
| 5,553,669 | A | 9/1996 | Trainer |
| 5,660,533 | A | 8/1997 | Cartwright |
| 5,845,709 | A | 12/1998 | Mack et al. |
| 6,126,416 | A | 10/2000 | Lee |
| 6,186,227 | B1 | 2/2001 | Vaynshteyn et al. |

(Continued)

FOREIGN PATENT DOCUMENTS

| | | | |
|---|---|---|---|
| CN | 108386160 | A | 8/2018 |
| GB | 2365046 | A | 2/2002 |
| WO | 2012169904 | A2 | 12/2012 |

OTHER PUBLICATIONS

"International Search Report and Written Opinion for PCT/US2023/035331 mailed Feb. 9, 2024".

*Primary Examiner* — Kristyn A Hall
(74) *Attorney, Agent, or Firm* — Baker Hughes Company

(57) ABSTRACT

A submersible pumping system for producing a fluid from a wellbore through production tubing to a wellhead includes a motor controlled by a motor drive, a pump driven by the motor, and one or more downhole sensors configured to measure conditions at the motor and pump. An intake fluid density control system has a control fluid reservoir positioned above the pump that is configured to release a density control fluid to the intake of the pump under the force of gravity. The release of the density control fluid can be controlled by a dump valve that automatically moves between open, closed, and intermediate positions in response to a control signal based on measurements made by the downhole sensors or motor drive.

14 Claims, 4 Drawing Sheets

(56) References Cited

U.S. PATENT DOCUMENTS

| | | | |
|---|---|---|---|
| 6,260,627 | B1 | 7/2001 | Rivas |
| 6,315,050 | B2 | 11/2001 | Vaynshteyn et al. |
| 6,564,876 | B2 | 5/2003 | Vaynshteyn et al. |
| 6,684,946 | B2 | 2/2004 | Gay et al. |
| 6,899,176 | B2 | 5/2005 | Hailey et al. |
| 7,357,186 | B1 | 4/2008 | Berry |
| 7,387,158 | B2 | 6/2008 | Murray et al. |
| 7,461,692 | B1 | 12/2008 | Wang |
| 7,462,225 | B1 | 12/2008 | Ketter et al. |
| 7,552,777 | B2 | 6/2009 | Murray et al. |
| 7,713,035 | B2 | 5/2010 | Ford |
| 7,841,395 | B2 | 11/2010 | Gay et al. |
| 8,322,450 | B2 | 12/2012 | Meijer |
| 8,584,744 | B2 | 11/2013 | Soni et al. |
| 8,998,586 | B2 | 4/2015 | Muhs |
| 9,283,497 | B2 | 3/2016 | Wang et al. |
| 9,447,661 | B2 | 9/2016 | Broussard et al. |
| 9,447,788 | B2 | 9/2016 | Henry et al. |
| 9,624,930 | B2 | 4/2017 | Gahlot et al. |
| 10,167,708 | B2 | 1/2019 | Beveridge |
| 10,344,580 | B2 | 7/2019 | Williams |
| 11,098,570 | B2 | 8/2021 | De et al. |
| 2002/0023750 | A1 | 2/2002 | Lopes et al. |
| 2003/0192702 | A1 | 10/2003 | Gay et al. |
| 2004/0020638 | A1 | 2/2004 | Williams |
| 2004/0129432 | A1 | 7/2004 | Wills et al. |
| 2004/0131488 | A1 | 7/2004 | Locher |
| 2005/0199551 | A1 | 9/2005 | Gordon |
| 2005/0281683 | A1 | 12/2005 | Brown et al. |
| 2008/0093085 | A1 | 4/2008 | Knight et al. |
| 2008/0110614 | A1 | 5/2008 | Orban |
| 2009/0065202 | A1 | 3/2009 | Brown et al. |
| 2009/0178803 | A1 | 7/2009 | Neuroth et al. |
| 2010/0175869 | A1 | 7/2010 | Cobb |
| 2010/0206732 | A1 | 8/2010 | Hale |
| 2011/0024119 | A1 | 2/2011 | Wolf et al. |
| 2011/0180272 | A1 | 7/2011 | Head |
| 2012/0057965 | A1 | 3/2012 | Bergamini et al. |
| 2013/0025865 | A1 | 1/2013 | Knobloch et al. |
| 2013/0068455 | A1 | 3/2013 | Brown et al. |
| 2013/0075105 | A1 | 3/2013 | Morton |
| 2013/0306330 | A1 | 11/2013 | Bishop et al. |
| 2014/0332239 | A1 | 11/2014 | Porta |
| 2015/0053394 | A1 | 2/2015 | Reid et al. |
| 2015/0075772 | A1 | 3/2015 | Saponja et al. |
| 2015/0098840 | A1 | 4/2015 | Kowalchuk |
| 2015/0167652 | A1 | 6/2015 | Van et al. |
| 2015/0204158 | A1 | 7/2015 | Frisby et al. |
| 2015/0205158 | A1 | 7/2015 | Engel et al. |
| 2015/0275619 | A1 | 10/2015 | Slup |
| 2015/0308245 | A1 | 10/2015 | Stewart et al. |
| 2015/0345276 | A1 | 12/2015 | Jensen |
| 2016/0003031 | A1 | 1/2016 | Xin et al. |
| 2016/0130919 | A1 | 5/2016 | Vasques |
| 2016/0222770 | A1 | 8/2016 | Kirk et al. |
| 2017/0175468 | A1 | 6/2017 | Vail, III et al. |
| 2017/0241215 | A1 | 8/2017 | Kleppa |
| 2017/0292361 | A1 | 10/2017 | Beauquin et al. |
| 2017/0342798 | A1 | 11/2017 | Wutherich |
| 2018/0112509 | A1 | 4/2018 | Saponja et al. |
| 2018/0171763 | A1 | 6/2018 | Malbrel et al. |
| 2018/0179852 | A1 | 6/2018 | Hou et al. |
| 2018/0223642 | A1 | 8/2018 | Zahran |
| 2018/0298736 | A1 | 10/2018 | Bailey et al. |
| 2019/0292893 | A1 | 9/2019 | El-Mahbes et al. |
| 2020/0032612 | A1 | 1/2020 | Joshi et al. |
| 2020/0165908 | A1 | 5/2020 | El-Mahbes et al. |
| 2020/0362683 | A1 | 11/2020 | El Mahbes et al. |
| 2020/0378235 | A1 | 12/2020 | Gonzales et al. |
| 2021/0148380 | A1 | 5/2021 | Brown et al. |
| 2021/0310352 | A1 | 10/2021 | Pelletier et al. |
| 2021/0348612 | A1 | 11/2021 | Dinkins et al. |

INTAKE FLUID DENSITY CONTROL SYSTEM

FIELD OF THE INVENTION

This invention relates generally to the field of downhole pumping systems, and more particularly to systems and methods for managing gas and liquid slugging events in submersible pumping systems.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface. In many cases, the pump assemblies are multi-stage centrifugal pumps that include a plurality of stages, with each stage including a stationary diffuser and a rotary impeller that is connected to a shaft driven by the electric motor.

Wellbore fluids often contain a combination of liquids and gases. Because most downhole pumping equipment is primarily designed to recover liquids, excess amounts of gas in the wellbore fluid can present problems for downhole equipment. For the centrifugal pump to operate, the pump must maintain its "prime," in which fluid is located in and around the "eye," or central intake portion, of the first impeller of the pump or gas separator. If, for example, a gas slug moves through the well to the pump intake, the pump may lose its prime and will thereafter be unable to pump liquids while gas remains around the eye of the impeller. The pump can be re-primed by moving fluids to the intake for the first impeller. Once the impeller is provided with a sufficient volume of liquid to displace the trapped gas, the pump will begin pumping against to clear the gas slug through the pump.

While it is known in the art to provide self-priming centrifugal pumps, the re-priming systems can be unreliable and even brief periods of gas lock may result in damage to downhole components in addition to the loss of production. There is, therefore, a continued need for an improved system for preventing a gas locked condition that would require re-the submersible centrifugal pump. It is to these and other deficiencies in the prior art that the disclosed embodiments are directed.

SUMMARY OF THE INVENTION

In some embodiments, the present disclosure is directed to a submersible pumping system for producing a fluid from a wellbore through production tubing to a wellhead, where the pumping system includes a motor and a pump driven by the motor, wherein the pump includes an intake and a discharge. The pumping system also includes an intake fluid density control system that has a control fluid reservoir positioned above the pump and configured to release a density control fluid to the intake of the pump under the force of gravity. In some embodiments, the intake fluid density control system also includes a dump valve and a dump line connected to the dump valve, where the dump line terminates near the intake of the pump.

In other embodiments, the present disclosure is directed to a submersible pumping system for producing a fluid from a wellbore through production tubing to a wellhead, where the pumping system has a motor and a pump driven by the motor. The pump includes an intake and a discharge connected to the production tubing. The pumping system further includes an intake fluid density control system that includes a density control fluid source, a delivery pump connected to the density control fluid source, and an injection line extending from the delivery pump to the intake of the pump.

In yet other embodiments, the present disclosure is directed to a submersible pumping system for producing a fluid from a wellbore through production tubing to a wellhead, where the pumping system includes a motor controlled by a motor drive, a pump driven by the motor, and one or more downhole sensors configured to measure conditions at the motor and pump. The pumping system further includes an intake fluid density control system that has a control fluid reservoir positioned above the pump that is configured to release a density control fluid to the intake of the pump under the force of gravity, a dump valve, and a dump line connected to the dump valve, where the dump line directs the density control fluid to pass from the control fluid reservoir to a location at or near the intake of the pump. In these embodiments, the dump valve can include a valve member and an actuator configured to move the valve member between open, closed or intermediate positions in response to a control signal based on measurements made by the downhole sensors or motor drive.

WRITTEN DESCRIPTION

As used herein, the term "petroleum" refers broadly to all mineral hydrocarbons, such as crude oil, gas and combinations of oil and gas. The term "fluid" refers to both liquids, gases or a mixture of liquids and gases, while the term "two-phase" specifically refers to a fluid that includes a mixture of both gases and liquids. It will be appreciated by those of skill in the art that, in the downhole environment, a two-phase fluid may also carry solids and suspensions. Accordingly, as used herein, the term "two-phase" not exclusive of fluids that contain liquids, gases, solids, or other intermediary forms of matter.

Figure 1:
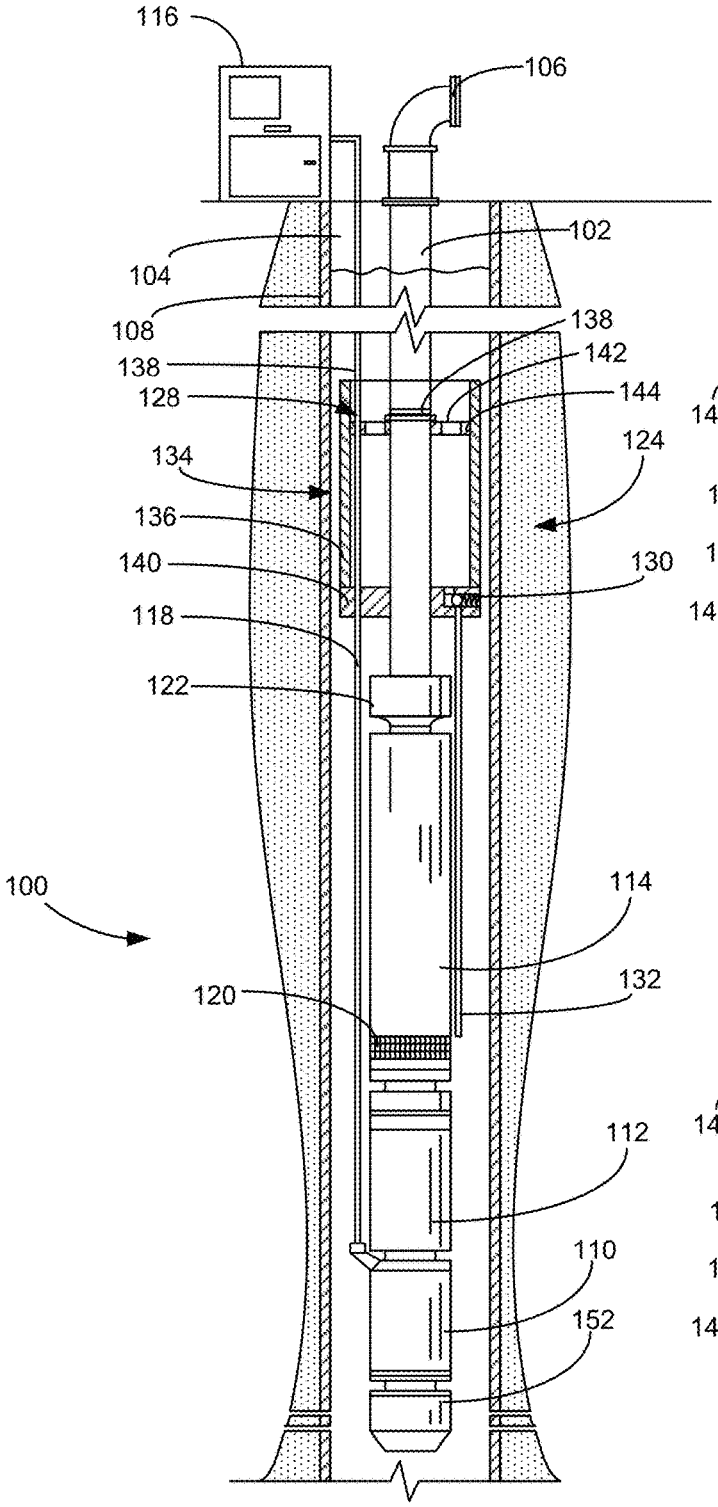
FIG. 1 is an elevational view of a first embodiment of an intake fluid density control system connected to an electric submersible pumping system disposed in a wellbore.

FIG. 1 shows an elevational view of a pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellhead 106 located on the surface. The wellbore 104 includes a casing 108 that may extend through all or part of the wellbore 104. The casing 108 can be perforated to permit the movement of fluids in the wellbore from a surrounding geologic formation. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

For the purposes of the disclosure herein, the terms "upstream" and "downstream" shall be used to refer to the relative positions of components or portions of components with respect to the general flow of fluids produced from the wellbore. "Upstream" refers to a position or component that is passed earlier than a "downstream" position or component as fluid is produced from the wellbore 104. The terms "upstream" and "downstream" are not necessarily dependent on the relative vertical orientation of a component or position.

It will be appreciated that many of the components in the pumping system 100 are substantially cylindrical and have a common longitudinal axis that extends through the center of the elongated cylinder and a radius extending from the longitudinal axis to an outer circumference. Objects and motion may be described in terms of axial, longitudinal, lateral, or radial positions within components in the pumping system 100. Although the pumping system 100 is disclosed in a vertical deployment, it will be appreciated that the pumping system 100 can also be deployed in horizontal and other non-vertical wellbores. The pumping system 100 can be deployed in onshore and offshore applications.

The pumping system 100 includes some combination of a motor 110, a seal section 112, and a pump 114. The motor 110 receives power from a surface-based drive 116 (e.g., a variable speed drive or a variable frequency drive) through one or more power cables 118. Generally, the motor 110 is configured to drive the pump 114 through a series of interconnected shafts (not shown). The seal section 112 shields the motor 110 from mechanical thrust produced by the pump 114 and provides for the expansion of motor lubricants during operation.

In some embodiments, the pump 114 is a turbomachine that uses one or more impellers and diffusers to convert mechanical energy into pressure head. In alternate embodiments, the pump 114 is configured as a positive displacement pump. The pump 114 transfers a portion of this mechanical energy to fluids within the wellbore 104, causing the wellbore fluids to move through the production tubing 102 to the wellhead 106 on the surface. The pump 114 includes an intake 120 and a discharge 122. The intake 120 receives fluids from the wellbore 104 and the discharge is connected to the production tubing 102.

The pumping system 100 also includes an intake fluid density control system 124. The intake fluid density control system 124 is generally configured to supply liquid directly or indirectly to the intake 120 of the pump 114 to control the overall density of fluids being drawn into the pump 114. In the embodiment depicted in FIG. 1, the intake fluid density control system 124 includes a control fluid reservoir 126, a fill assembly 128, a dump valve 130 and a dump line 132.

Figure 2:
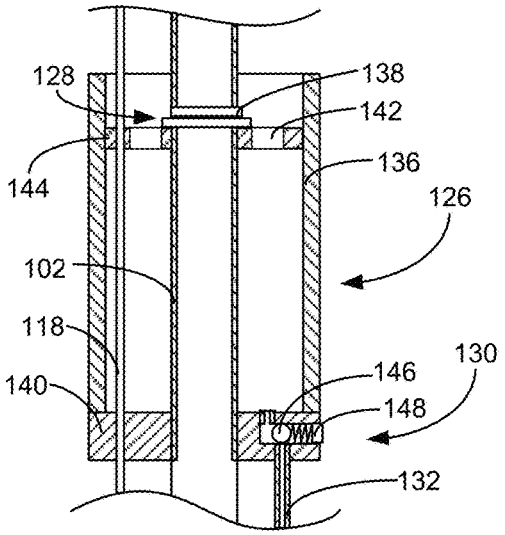
FIG. 2 provides a cross-sectional depiction of a first variation of the control fluid reservoir of the intake fluid density control system of FIG. 1.

As illustrated in the close-up cross-sectional view in FIG. 2, the control fluid reservoir 126 includes a reservoir housing 134 that is secured to the production tubing 102 above pump 114. The housing 134 can include a body 136 that is connected to upper and lower hangers 138, 140. The upper and lower hangers 138, 140 include a sealed interface with the production tubing 102, power cable 118 and dump line 132. In some embodiments, the upper hanger 138 includes one or more vents that permit the release of gases trapped in the control fluid reservoir 126. In some embodiments, the body 136 is cylindrical and has an outer diameter that approaches the inner diameter of the casing 108. The control fluid reservoir 126 can be more than 100 feet long in some embodiments. In one embodiment, the control fluid reservoir 126 is about 120 feet long.

Figure 3:
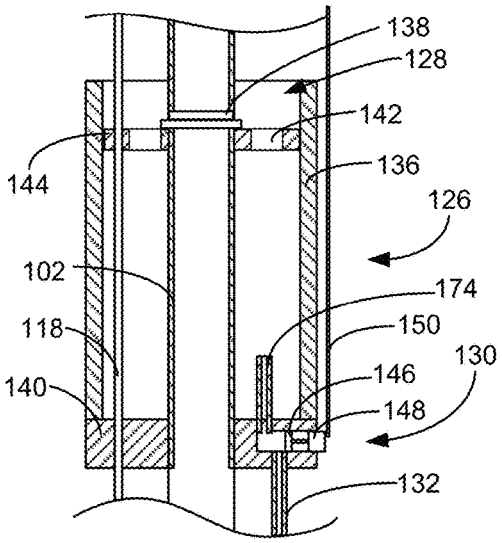
FIG. 3 provides a cross-sectional depiction of a second variation of the control fluid reservoir of the intake fluid density control system of FIG. 1.

In the embodiments depicted in FIGS. 2 and 3, the fill assembly 128 includes one or more fill ports 142 that extend through a reservoir top 144, which may connected to or made integral with the upper hanger 138 of the control fluid reservoir 126. Fluid inside the control fluid reservoir 126 will be referred to as "density control fluid" in this disclosure. In some embodiments, the density control fluid is water, brine, produced fluids, or other liquid-rich fluids.

In the variations depicted in FIGS. 2 and 3, the dump valve 130 is connected to the dump line 132, which extends below the control fluid reservoir 126 to a location in close proximity with the intake 120 of the pump 114. In some embodiments, the dump line 132 is connected between the intake 120 and the control fluid reservoir 126. The dump line 132 can be a length of capillary tubing or other small-diameter tubing that is capable of carrying a sufficient volume of density control fluid to the pump intake 120 under the force of gravity.

In the variation depicted in FIG. 2, the dump valve 130 is a mechanical valve that is configured to open when the pressure differential between the interior of the control fluid reservoir 126 and the annular space within the wellbore 104 around the outside of the control fluid reservoir 126 exceeds a threshold value. The dump valve 130 includes a valve member 146 and an actuator 148. As depicted in FIG. 2, the actuator 148 includes a pilot piston and spring, which move in response to pressure changes in the wellbore 104. The valve member 146 can be a valve ball or piston that reveals or conceals the dump line 132 in response to movement by the actuator 148.

During a gas slugging event, the reduction in pressure around the outside of the control fluid reservoir 126 causes the actuator 148 to move the valve member 146 into an open position, which permits the dump valve 130 to drain the density control fluid from the control fluid reservoir 126 to the pump intake 120 through the dump line 132. In this way, the dump valve 130 can be a pressure-modulated mechanical valve. In other variations, the actuator 148 and valve member 146 can include various combinations of diaphragms, springs and seating elements that are automatically shifted between open, closed and intermediate positions depending on the pressure gradient across the dump valve 130.

In other embodiments, as depicted in the variation of FIG. 3, the dump valve 130 is an active, powered valve that is controlled by an external source through a control line 150. The dump valve 130 can be pneumatic, hydraulic or electric and configured to receive a control signal through the control line 150. In this variation, the actuator 148 drives the valve member 146 between open, closed and intermediate positions in response to appropriate control signals carried through the control line 150.

The control line 150 can be connected to surface-based equipment, like the motor drive 116, or to downhole sensors 152 connected to the pumping system 100. In each case, the dump valve 130 can be manually or automatically changed between binary open and closed states, or proportional intermediate states by sending appropriate control signals through the control line 150. In some embodiments, the downhole sensors 152 are configured to detect the presence of large gas pockets approaching the pump intake 120, which would reduce the pump intake pressure (PIP) measured by the downhole sensors 152. The downhole sensors 152 can be configured to automatically open the dump valve 130 by sending an appropriate "open" signal through the control line 150. Once the pump intake pressure (PIP) has returned to a value within the acceptable operating range, the downhole sensors 152 are configured to close the dump valve 130 by sending an appropriate "close" signal through the control line 150. The downhole sensors 152 can be configured to operate the dump valve 130 based on other measurements, including casing pressure, temperature, and the liquid-to-gas ratio of wellbore fluids approaching the pump intake 120.

In other embodiments, the control signal is generated by the motor drive 116 in response to a change in the operation of the motor 110. For example, the control signal can be generated based on a decrease in power (amperage) drawn by the motor 110 which reflects a lack of liquid inside the pump 114, or an increase in the temperature of the motor 110 which reflects a lack of convective cooling by liquids surrounding the motor 110. It will be appreciated that the dump valve 130 can be controlled using a combination of factors and measurements that are combined to produce the appropriate binary or proportional control signal. For example, the dump valve 130 can be instructed to open when the downhole sensors 152 measure a decrease in the pump intake pressure followed by a decrease in the power drawn by the motor 110.

In each case, the rate at which the density control fluid is delivered to the pump intake 120 by the intake fluid density control system 124 can be modulated based on the amount of gas present or predicted at the pump intake 120. This allows the intake fluid density control system 124 to deliver liquid-rich density control fluid to the pump intake 120 over an extended period, or on a continuous basis, while excess gas is present at the pump intake 120. Unlike prior art systems that attempt to relieve a gas locking condition by re-priming the pump, the intake fluid density control system 124 can be configured to proactively prevent or mitigate the gas locking condition by delivering the density control fluid to the pump intake 120 to increase the overall density of fluid passing through the pump 114.

During use, the control fluid reservoir 126 may collect sediment, sand, or other solid particles that are entrained within the pumped fluid from the production tubing 102. To prevent solid particles from blocking or becoming trapped in the dump valve 130, the control fluid reservoir 126 optionally includes a drain intake 174 that that extends upward into the control fluid reservoir 126 from the dump valve 130 and lower hanger 140.

Figure 4:
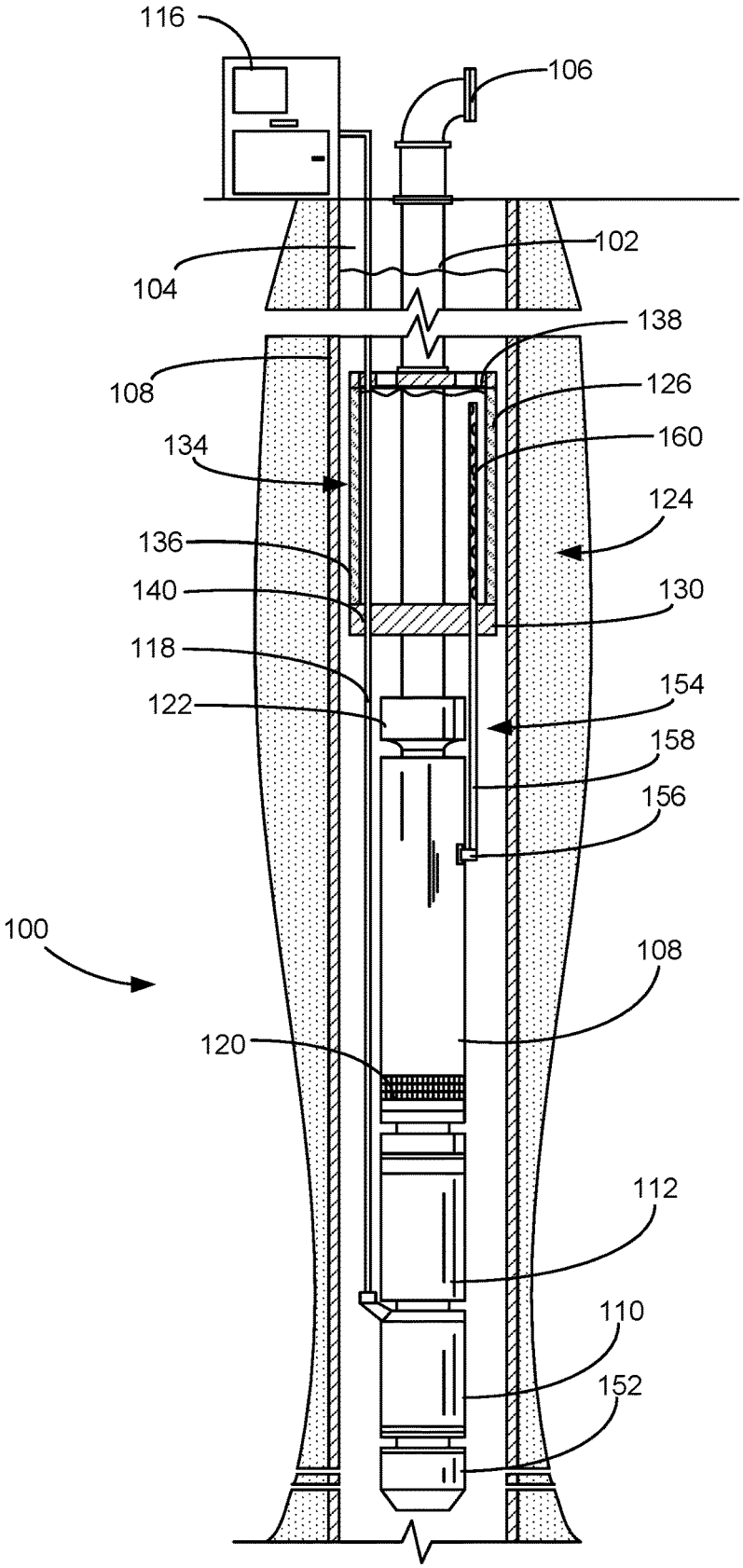
FIG. 4 is an elevational view of a second embodiment of an intake fluid density control system connected to an electric submersible pumping system disposed in a wellbore.

Turning to FIG. 4, shown therein is a second embodiment of the intake fluid density control system 124. In this embodiment, a bypass pump fill assembly 154 is used to provide density control fluid to the control fluid reservoir 126. The bypass pump fill assembly 154 includes a pump tap 156 and a fill tube 158 that extends from the pump tap 156 to the interior of the control fluid reservoir 126. The pump tap 156 extends into the pump 114 at a selected stage and is configured permit a portion of the pumped fluid moving through the pump 114 to be discharged through the pump tap 156 into the fill tube 158. The fill tube 158 discharges the fluid into the control fluid reservoir 126. In some embodiments, as depicted in FIG. 4, the fill tube 158 includes a perforated section 160 within the control fluid reservoir 126.

In exemplary embodiments, the pump tap 156 is strategically placed within the pump 114 such that the pressure head available in the fill tube 158 is approximately equal to the static height between the pump tap 156 and the upper portion of the control fluid reservoir 126. As such, once the control fluid reservoir 126 has been filled by the bypass pump fill assembly 154 is configured to fill the control fluid reservoir 126, the force applied by the column of fluid above the pump tap 156 prevents further fluid from being discharged from the pump 114 through the fill tube 158.

If the pump 114 loses prime or becomes inefficient because of excess gas in the pumped fluid, the pressure inside the pump 114 will decrease and will no longer be able to support the weight of the fluid within the fill tube 158 and control fluid reservoir 126. This causes the reverse flow of density control fluid from the control fluid reservoir 126 to enter the pump 114 through the fill tube 158 and pump tap 156. Draining the control fluid reservoir 126 back through the pump 114 can increase the overall density of fluids at the pump intake 120, which can return the pump 114 to normal operation. Once the pump 114 has resumed normal operation and the pressure generated at the pump tap 156 returns to a normal range, the control fluid reservoir 126 is filled again by fluid diverted through the pump tap 156 and fill tube 158. In this way, the bypass pump fill assembly 154 relies on the fill tube 158 and pump tap 156 to both fill and drain the control fluid reservoir 126 without the need for the dedicated fill valve 144 or dump valve 130. In this embodiment, the fill ports 142 may be present or omitted from the reservoir top 144.

Figure 5:
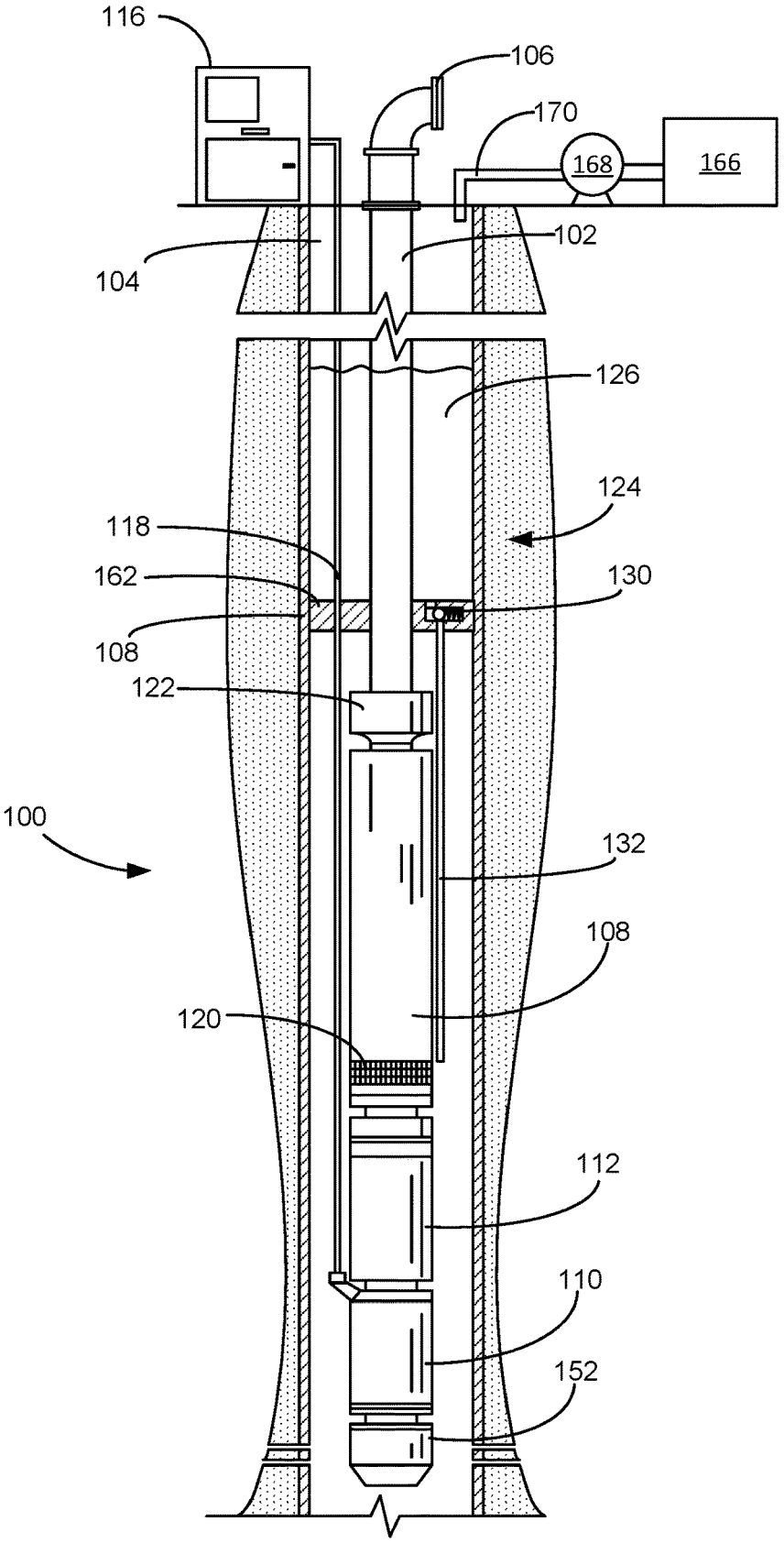
FIG. 5 is an elevational view of a third embodiment of an intake fluid density control system connected to an electric submersible pumping system disposed in a wellbore.

Turning to FIG. 5, shown therein is yet another embodiment of the intake fluid density control system 124 in which the control fluid reservoir 126 is integrated into the casing 108 with a packer 162. The packer 162 includes penetrators for the power cable 118 and production tubing 102. The packer 162 and casing 108 together form the control fluid reservoir 126, which can be filled using the bypass pump fill assembly 154, production tubing fill assembly 128, or with a surface fill system 164. The surface fill system 164 includes a density control fluid source 166, a delivery pump 168 and an injection line 170. The delivery pump 168 is configured to pump a suitable density control fluid, such as water, brine or produced fluids, into the upper part of the annular space within the wellbore 104, where it collects within the control fluid reservoir 126 formed by the packer 162 and casing 108. The volume of density control fluid within the control fluid reservoir 126 can be automatically controlled by a level control sensor 172, which can be secured to the packer 162, the production tubing 102 or the casing 108. The density control fluid can be drained out of the control fluid reservoir 126 with the dump valve 130 and dump line, as described above.

Figure 6:
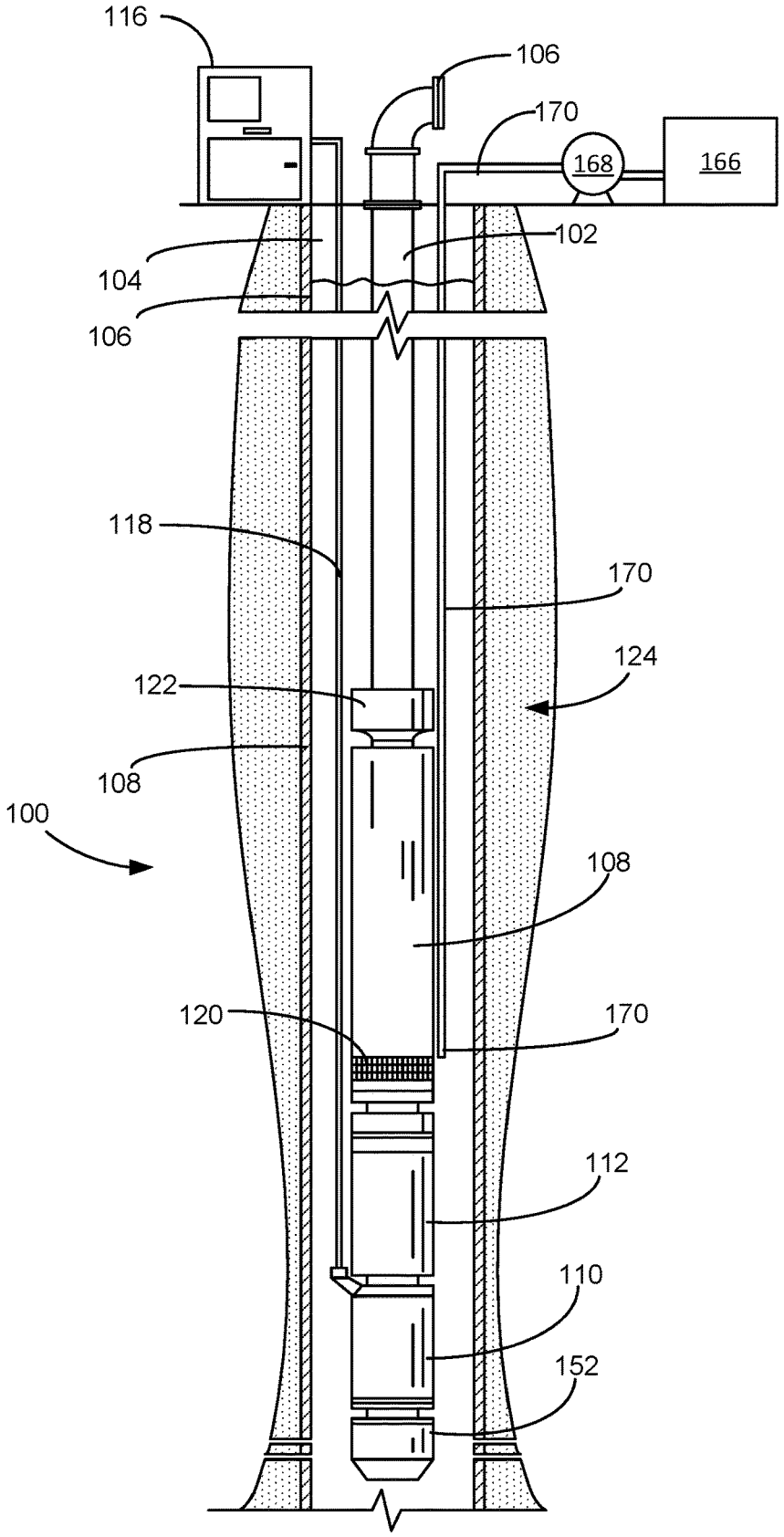
FIG. 6 is an elevational view of a fourth embodiment of an intake fluid density control system connected to an electric submersible pumping system disposed in a wellbore.

Turning to FIG. 6, shown therein is yet another embodiment of the intake fluid density control system 124. In this embodiment, the density control fluid is supplied on an as-needed basis by the surface fill system 164 without the use of the control fluid reservoir 126. In this embodiment, the injection line 170 extends from the delivery pump 168 to the pump 114, where the injection line can terminate near or on the pump intake 120. In response to an indication that a gas slugging event has or will adversely affect the performance of the pump 114, the delivery pump 168 can be automatically activated to supply a volume of density control fluid to the pump 114.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated that concepts from one embodiment can be combined with concepts from another embodiment. For example, it may be desirable to employ the bypass pump fill assembly 154 in combination with the control fluid reservoir 126 that utilizes the packer 162 rather than the upper and lower hangers 138, 140. It will be further appreciated by those skilled in the art that the teachings of the present invention can be applied to other systems without departing from the scope and spirit of the present invention.

What is claimed is:

1. A submersible pumping system for producing a fluid from a wellbore through production tubing to a wellhead, the pumping system comprising:
- a motor;
- a pump driven by the motor, wherein the pump includes an intake and a discharge; and
- an intake fluid density control system, wherein the intake fluid density control system comprises:
  - a control fluid reservoir positioned above the pump and configured to release a density control fluid to the intake of the pump under the force of gravity, wherein the control fluid reservoir comprises:
    - an upper hanger connected to the production tubing;
    - a lower hanger connected to the production tubing; and
    - a body connected between the upper hanger and the lower hanger;
  - a dump valve, wherein the dump valve comprises:
    - a valve member; and
    - an actuator configured to move the valve member between open, closed or intermediate positions to permit the density control fluid to pass into the dump line from the control fluid reservoir; and
    - wherein the dump valve is a mechanical dump valve and the actuator is energized by a pressure gradient between the control fluid reservoir and an annular space surrounding the control fluid reservoir in the wellbore; and
  - a dump line connected to the dump valve, wherein the dump line terminates near the intake of the pump.

2. The submersible pumping system of claim 1, wherein the dump valve is located within the lower hanger.

3. The submersible pumping system of claim 1, wherein the intake fluid density control system includes a fill assembly connected to the production tubing.

4. The submersible pumping system of claim 1, wherein the wellbore comprises a casing and the control fluid reservoir comprises a packer positioned within the casing above the pump.

5. The submersible pumping system of claim 4, wherein the intake fluid density control system further comprises a surface fill system that in turn comprises:
- a density control fluid source;
- a delivery pump connected to the density control fluid source; and
- an injection line connected to the delivery pump.

6. A submersible pumping system for producing a fluid from a wellbore through production tubing to a wellhead, the pumping system comprising:
- a motor;
- a pump driven by the motor, wherein the pump includes an intake and a discharge; and
- an intake fluid density control system, wherein the intake fluid density control system comprises:
  - a control fluid reservoir positioned above the pump and configured to release a density control fluid to the intake of the pump under the force of gravity; and
  - a fill assembly connected to the production tubing, wherein the fill assembly comprises one or more fill ports that extend through a top of the control fluid reservoir to an annular space surrounding the control fluid reservoir in the wellbore.

7. A submersible pumping system for producing a fluid from a wellbore through production tubing to a wellhead, the pumping system comprising:
- a motor;
- a pump driven by the motor, wherein the pump includes an intake and a discharge; and
- an intake fluid density control system, wherein the intake fluid density control system comprises:
  - a control fluid reservoir positioned above the pump and configured to release a density control fluid to the intake of the pump under the force of gravity; and
  - a fill assembly connected to the production tubing, wherein the fill assembly comprises one or more fill ports that extend through the upper hanger.

8. A submersible pumping system for producing a fluid from a wellbore through production tubing to a wellhead, the pumping system comprising:
- a motor;
- a pump driven by the motor, wherein the pump includes an intake and a discharge; and
- an intake fluid density control system, wherein the intake fluid density control system comprises:
  - a control fluid reservoir positioned above the pump and configured to release a density control fluid to the intake of the pump under the force of gravity; and
  - a bypass pump fill assembly configured to fill the control fluid reservoir.

9. The submersible pumping system of claim 8, wherein the bypass pump fill assembly comprises:
- a pump tap extending into the pump between the pump discharge and the pump intake; and
- a fill tube connected between the pump tap and the control fluid reservoir.

10. The submersible pumping system of claim 9, wherein the fill tube further comprises a perforated section within the control fluid reservoir.

11. The submersible pumping system of claim 9, wherein the pump tap is located at a stage within the pump that produces a pressure head that is substantially equivalent to the distance between the pump tap and the top of the fill tube.

12. The submersible pumping system of claim 11, wherein the intake fluid density control system does not include a dedicated dump valve.

13. A submersible pumping system for producing a fluid from a wellbore through production tubing to a wellhead, the pumping system comprising:
- a motor, wherein the motor is controlled by a motor drive;
- a pump driven by the motor, wherein the pump includes an intake and a discharge;

downhole sensors configured to measure conditions at the motor and pump to detect the presence of gas pockets approaching the pump intake from upstream of the pump intake in the wellbore; and an intake fluid density control system, wherein the intake fluid density control system comprises:

a control fluid reservoir positioned above the pump and configured to release a density control fluid to the intake of the pump under the force of gravity;

a dump valve, wherein the dump valve comprises:

a valve member; and an actuator configured to move the valve member between open, closed or intermediate positions in response to a control signal based on measurements made by the downhole sensors or motor drive; and a dump line connected to the dump valve, wherein the dump line directs the density control fluid to pass from the control fluid reservoir to a location at or near the intake of the pump.

14. The submersible pumping system of claim 13, wherein the dump valve is an electrically actuated dump valve and the actuator is driven by an electric control signal.

* * * * *